US007086945B2

(12) United States Patent
Vancura

(10) Patent No.: US 7,086,945 B2
(45) Date of Patent: Aug. 8, 2006

(54) METHOD FOR OPERATING A CASINO GAME HAVING A NUMBER OF PLAY PATHS

(75) Inventor: Olaf Vancura, Las Vegas, NV (US)

(73) Assignee: Progressive Gaming International Corporation, Las Vegas, NV (US)

( * ) Notice: Subject to any disclaimer, the term of this patent is extended or adjusted under 35 U.S.C. 154(b) by 0 days.

(21) Appl. No.: 11/105,283

(22) Filed: Apr. 13, 2005

(65) Prior Publication Data

US 2005/0187004 A1 Aug. 25, 2005

Related U.S. Application Data

(63) Continuation of application No. 10/812,487, filed on Mar. 30, 2004, which is a continuation of application No. 10/177,489, filed on Jun. 20, 2002, now Pat. No. 6,726,562, which is a continuation of application No. 09/659,430, filed on Sep. 8, 2000, now Pat. No. 6,409,172.

(51) Int. Cl.
*A63F 3/00* (2006.01)
*G07F 17/34* (2006.01)

(52) U.S. Cl. ..... 463/20; 463/22; 463/25; 463/16; 273/138.2; 273/143 R; 273/249; 273/237; 273/274

(58) Field of Classification Search ..... 273/143 R, 273/138.1, 138.2, 256, 274; 463/20, 12, 463/13, 16, 22, 15, 25
See application file for complete search history.

(56) References Cited

U.S. PATENT DOCUMENTS 4,397,467 A 8/1983 Thornton
4,648,600 A 3/1987 Olliges
4,887,819 A 12/1989 Walker
4,930,789 A 6/1990 Harris et al.
4,932,665 A 6/1990 Fejdasz et al.
5,803,451 A 9/1998 Kelly et al.
5,810,359 A 9/1998 Wilkins et al.
5,823,874 A 10/1998 Adams
5,833,239 A 11/1998 Eleidjian
2002/0010018 A1 1/2002 Lemay et al.
2002/0016200 A1 2/2002 Baerlocher et al.

OTHER PUBLICATIONS

"Phantom Haus" Operations Manual, Williams Electronics Games, Inc. Jul. 1996.

*Primary Examiner*—Benjamin Layno
(74) *Attorney, Agent, or Firm*—Dorr, Carson & Birney, P.C.

(57) ABSTRACT

A method for playing a game has the steps of establishing a plurality of paths, each of which have a plurality of squares including a start square, an end square, and a plurality of value squares. Randomly traversing the paths to afford the possibility of two or more moves to reach the end square. Allowing a player to select one of the paths. Moving along the player selected path randomly, while awarding the player the values associated with squares landed upon. The randomness is by the steps of spinning a spinner, rolling a die or dice, employing a wheel, flipping a coin, or the use of a random number generator. The step of establishing a plurality of paths, each having a plurality of squares includes using a stop square, squares which cause additional movement. The steps of establishing intersecting paths or establishing one or more squares having a game associated with them are practiced. The method is in a casino game and a bonus game for a base game.

26 Claims, 9 Drawing Sheets

| | | | |
|---|---|---|---|
| WIN 0 | WIN 100 | WIN 80 | WIN 0 |
| START | | | END |
| WIN 50 | WIN 60 | WIN 30 | WIN 40 |

FIG.6

| | | | | | | |
|---|---|---|---|---|---|---|
| START | WIN 20 | WIN 30 | WIN 40 | WIN 50 | WIN 60 | END |
| START | WIN 0 | WIN 0 | WIN 0 | WIN 0 | WIN 200 | END |
| START | WIN 0 | WIN 50 | WIN 95 | WIN 50 | WIN 0 | END |
| START | WIN 0 | WIN 40 | WIN 60 | WIN 45 | WIN 50 | END |

FIG.7

| START NODE | | |
|---|---|---|
| WIN 30 | WIN 23 | LOSE 40 |
| WIN 30 | WIN 73 | WIN 100 |
| WIN 30 | LOSE 22 | LOSE 67 |
| WIN 30 | WIN 45 | WIN 150 |
| WIN 30 | WIN 20 | LOSE 30 |
| END NODE | | |

FIG.9

METHOD FOR OPERATING A CASINO GAME HAVING A NUMBER OF PLAY PATHS

CROSS REFERENCE TO RELATED APPLICATIONS

This application is a continuation of U.S. patent application Ser. No. 10/812,487 filed Mar. 30, 2004 which is a continuation of U.S. patent application Ser. No. 10/177,489 filed Jun. 20, 2002, now U.S. Pat. No. 6,726,562 issued Apr. 27, 2004 which is a continuation of U.S. patent application Ser. No. 09/659,430 filed Sep. 8, 2000, now U.S. Pat. No. 6,409,172 issued Jun. 25, 2002.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to casino games and, in particular, to improvements in the methods of playing bonus games on slot machines.

2. Description of the Related Art Including Information Disclosed Under 37 CFR 1.97 and 1.98

Slot machines have become the most important contributor to revenue on casino floors. Among slot machines, those with a bonus game have become especially popular. Typically in these machines, a player plays the underlying game (sometimes referred to as the base game) with the usual pays for predefined combinations of symbols.

Occasionally, the player will qualify for a bonus event. This is usually triggered through the alignment of one or more special symbols (sometimes referred to as trigger symbols) as an event which initiate the bonus game. Hence, the bonus game is generally a somewhat rare and special occurrence that affords the player an opportunity to participate in an ancillary component of the slot machine with an associated award. Usually, no additional wager is required; the bonus game is an opportunity for the player to earn an additional award risk-free.

The bonus award may be distributed by the slot machine in various ways, including adding to the base game credits, the use of an external "top-box", or the use of a second-screen in the case of video. Too, the bonus game may simply be a random choice of several prizes, one or more free base games, and so forth.

By use of the terms bonus game, there is intended no limitations to any particular form of bonus award. Rather, reference to a "bonus game" as one which is different than the traditional base game play. The bonus game may be housed separately from the reels (for example, in a spinning-reel slot machine with a top-box bonus), or may be simply on an additional screen (for example, in a video-reel slot machine). Too, for the purposes of the teachings herein, the manner and equipment that initiates a bonus game (e.g., combination of special symbols as described above or other methods) are immaterial to the present disclosure.

There continues to be a need to enhance the bonus experience for slot machine players. In particular, players desire a feeling of control over the outcome of the bonus game. This may be accomplished in fairly crude ways, such as selecting one of five elements to reveal an award. However, such crude ways may lead quickly to apathy on the part of sophisticated and/or regular players, who are always looking for challenge and variety.

The feeling of control may also be accomplished by allowing the player to additionally wager during the bonus game. For example, the Monopoly® Once Around game by WMS Gaming utilizes a Monopoly board and has the player start at "Go" and, using the outcome of a pair of dice, traverse the periphery of the board once. Before beginning, players are given the opportunity to "buy" (for an additional wager) houses and hotels on the various properties, in the hopes that they will be landed upon for an increased award. The result is that that an unlucky player may actually be a net loser during the bonus game.

Another manner in which a bonus game may afford the player control is via the use of a strategy game. For example, the use of Yahtzee® poker dice in games by Mikohn Gaming, Inc. of Las Vegas, Nev. as a bonus game has proved very popular. However, insofar as games of strategy generally afford considerable replay value, the rules of the game must nevertheless be learned. As such, the time required assimilating a "learning curve" by the casual player is best minimized.

Thus, there exists a need for bonus games that have essentially no learning curve, yet afford considerable replay value. In particular, a need exists for a bonus game in which the player is given distinct and meaningful choices, but whose outcome is nevertheless controlled in such a fashion as to ensure the operator's expected margin for the slot machine.

BRIEF SUMMARY OF THE INVENTION

The solution, as disclosed herein, may include a bonus game with multiple paths emanating from a common node. The multiple paths represent, both mathematically and from a game-flow point of view, meaningful choices the player may make while participating in the bonus game. In this fashion, the player keeps several desirable attributes including control over the direction of the bonus game and, as will be described shortly, relative risk and/or volatility of the game. The operator, meanwhile, retains control over the expected value of the bonus award, hence house advantage of the overall machine.

It is an advantage of the present invention that the player is given distinct strategic choices, while the outcome is nevertheless controlled in such a fashion as to ensure the operator's house advantage. It is a further advantage of the present invention that the bonus games described herein have almost no learning curve yet still afford considerable replay value.

As a preferred embodiment, the player is offered the choice of a plurality of paths, a path being defined as being traversed in at least one but possibly more moves. Herein each move is defined by a "square" but the geometry of the space moved to is not necessarily important as it is just a place or position having a value or in some cases no value or a loss of value.

BRIEF DESCRIPTION OF THE DRAWING

FIG. 6 is an example showing a form of game play.

FIG. 7 is another example showing another form of game play.

FIG. 9 is yet one more example showing a still further form of game play.

DETAILED DESCRIPTION OF THE INVENTION

Figure 1:
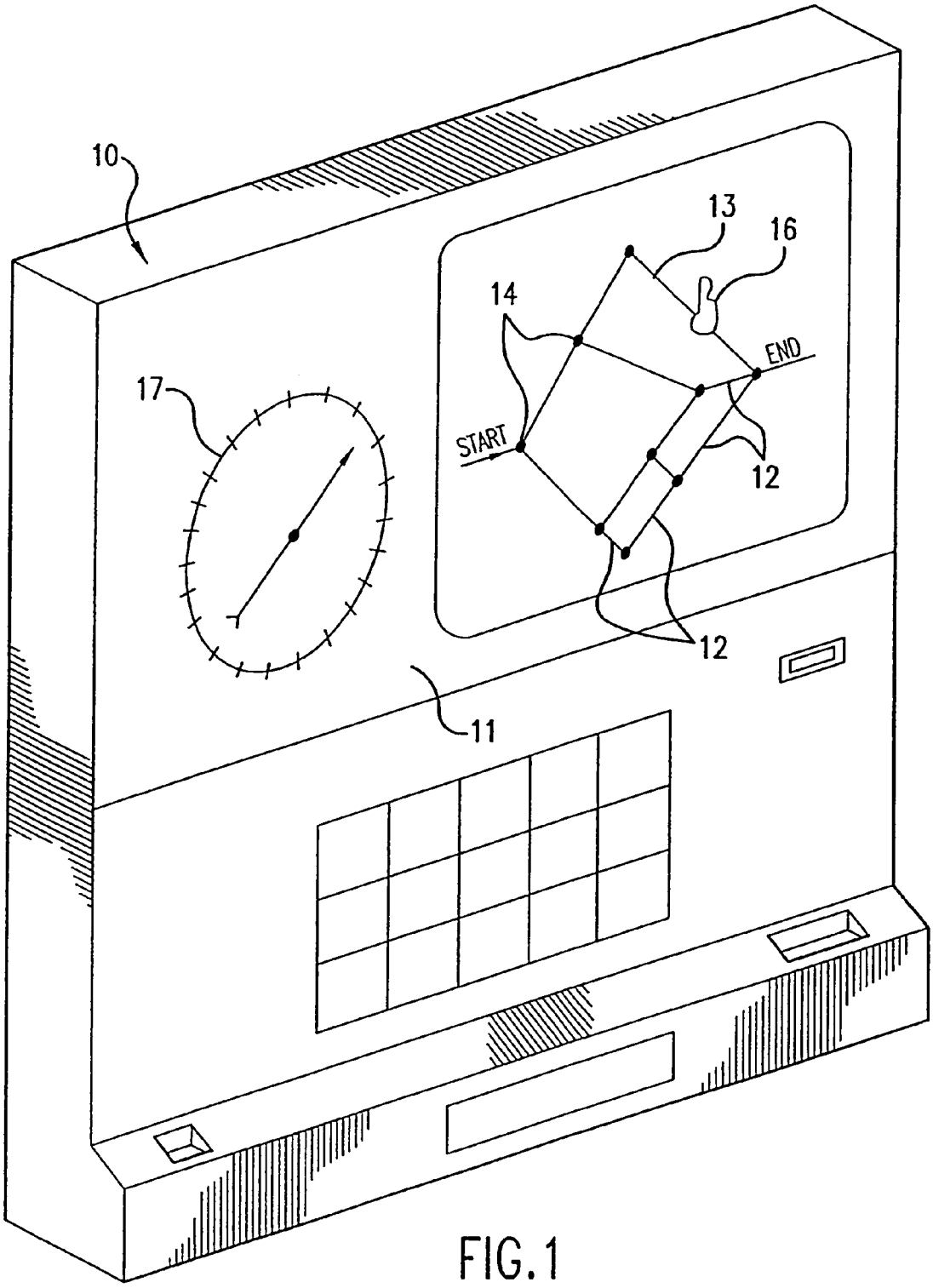
FIG. 1 is an illustration of an embodiment of a casino game of chance.

As an example of the present invention, consider the following topology in which the player begins at "Start" on the left-hand side. The player must choose which path (upper or lower) to take to the "End" square, see FIG. 6 for example.

A random "spinner", of the type conventionally known and programmable for random disposition (with equal probability), is used to roll each of the numbers 1 through 4; e.g., in a video format, a quartered pie-wedge circle may be depicted with overlaid spinner.

After the player has chosen a path (say, the lower), the spinner is spun, and a marker traverses the path. For example, if the first spin ended in a 2, the marker would depict movement from "Start" to the "Win 60" square. The player would be awarded 60 credits. The spinner is spun again, and play continues until the marker reaches the "End" square.

The expected value hereafter "EV" for each path may be calculated by skilled artisans using, e.g. combinatorial analysis or Monte Carlo simulation. Below please find the calculated results for the above example. Shown is the probability herein "P" of landing on each of the 4 squares along either path (note that the probabilities sum to a value greater than 1, reflecting the fact that multiple squares may be landed upon during traversal of a given path):

$$P(1)=\tfrac{1}{4}=64/256$$

$$P(2)=\tfrac{1}{4}\times\tfrac{1}{4}+\tfrac{1}{4}=80/256$$

$$P(3)=\tfrac{1}{4}+2\times\tfrac{1}{4}\times\tfrac{1}{4}+\tfrac{1}{4}\times\tfrac{1}{4}\times\tfrac{1}{4}=100/256$$

$$P(4)=\tfrac{1}{4}+3\times\tfrac{1}{4}\times\tfrac{1}{4}+3\times\tfrac{1}{4}\times\tfrac{1}{4}\times\tfrac{1}{4}+\tfrac{1}{4}\times\tfrac{1}{4}\times\tfrac{1}{4}\times\tfrac{1}{4}=125/256$$

Thus, the EV for the upper path is equal to $(80/256)\times 100+(100/256)\times 80=62.5$. The EV for the lower path is equal to $(64/256)\times 50+(80/256)\times 60+(100/256)\times 30+(125/256)\times 40=62.5$.

Thus, a game has been constructed that affords the player the option of choosing a path to take, while affording the house a fixed expected value regardless of which path the player chooses. In particular, the player may choose a path with greater volatility or less volatility, but the game is assured of a known, pre-calculated expected value regardless of the strategy adopted by the player. As used herein, volatility relates to the standard deviation of the distribution of possible values about the expected value.

As used herein, volatility relates to the standard deviation of the distribution of possible values about the expected values. A simulation of the game confirms the expected values for both paths and suggests a standard deviation of approximately 54 units for the upper path and 31 units for the lower path. Hence, in this case, the upper path is more volatile (in terms of possible outcomes after path traversal) to the player.

If desired, another even more volatile "path" with "Win 0" in positions 1, 3, and 4, and "Win 200" in position 2 may be constructed. It can be confirmed, using the aforementioned probabilities, that the EV for this new path is also 62.5. The associated standard deviation is approximately 93.

The examples given above are for specific paths (of length 5), a specific random means of traversing the path (random and equal distribution of 1 through 4 squares per turn), and a specific EV for each path. However, other path lengths and random means and approaches are possible, as skilled artisans will appreciate. Hence, the foregoing is meant as an illustration via a specific example but is not intended in any way to limit the teachings herein disclosed.

Too, the aforementioned example had the player choose the path at the beginning. It is within the scope of this invention to have the choice occur later. For example, the player may start down a given path, and upon reaching a "fork" be given a choice at that juncture. As used herein the terms along a path such as, juncture, fork, node and the like all relate to decision points or choices for the player and may include more than two alternatives. For example, three alternatives along a path could be angle left, angle right or go straight ahead.

As an example, a design choice may be to use more than two possible paths. This gives the player even more choices, in a controlled fashion, and thus further accommodates different styles of play. Consider the following case in which the player begins at "Start" on the left and is offered four horizontal paths to take to "End" on the right. A coin is flipped with heads moving the player forward 1 square, and tails moving the player forward 2 squares, see FIG. 7 for example.

A calculation similar to that described above yields the following results.

$$P(1)=\frac{1}{2}=16/32$$

$$P(2)=\frac{1}{2}+\frac{1}{2}\times\frac{1}{2}=24/32$$

$$P(3)=2\times\frac{1}{2}\times\frac{1}{2}+\frac{1}{2}\times\frac{1}{2}\times\frac{1}{2}=20/32$$

$$P(4)=\frac{1}{2}\times\frac{1}{2}+3\times\frac{1}{2}\times\frac{1}{2}\times\frac{1}{2}+\frac{1}{2}\times\frac{1}{2}\times\frac{1}{2}\times\frac{1}{2}=22/32$$

$$P(5)=3\times\frac{1}{2}\times\frac{1}{2}\times\frac{1}{2}+4\times\frac{1}{2}\times\frac{1}{2}\times\frac{1}{2}\times\frac{1}{2}+\frac{1}{2}\times\frac{1}{2}\times\frac{1}{2}\times\frac{1}{2}=21/32$$

Inserting the appropriate values from each of the four paths yields an EV of 131.25 regardless of path chosen. In this manner, the player may be given an arbitrary number of paths; each constructed in conformity with the teachings herein provided. It is an advantage of this invention that the numbers of paths, and the values of their squares, afford considerable flexibility in game design.

Although the preferred embodiment uses paths with identical lengths, another embodiment may use paths of differing lengths. For example, path "A" may have 10 steps while path "B" may have only 6 steps, and so forth. Again, the probabilities of landing on each path square may be determined, so that the calculated theoretical EV associated with each path is equal or approximately so.

It is another advantage of this invention that the random ways of traversal are design choices. For example, a design choice may be, as part of a random means of movement, to afford the possibility of moving 0 squares in some instances. In the case of no movement, the player may again be given the value of the square currently "stuck" upon, or may simply stay upon the square without again being awarded the square's value. In either case, the respective probabilities of landing on each square may be calculated to determine the resultant EV associated with each path.

While the preferred embodiment uses identical ways of traversing each path, in another embodiment different ways of traversing each path are prescribed. For example, path "A" may be traversed by rolling a single die and moving forward the number of steps shown, while path "B" may be traversed by throwing two dice and moving forward the sum of the steps. Clearly, other possibilities exist as will be apparent to one skilled in the art.

Furthermore, note that the EV of each path need not be mathematically identical. The general teachings of this invention are meant to allow the player flexibility over choice of outcomes in a controlled fashion. It is within the scope of this invention to construct different paths with expected values that are not identical, and in some cases quite dissimilar, yet still provide for an overall game return within a known range acceptable to the operator.

As an example of the foregoing, note that a typical slot machine game may be described as having a total return "ERtot" per unit wagered. ERtot may be made up of contributions from the base game ERbase and one or more bonus games ERbonus (for simplicity only one bonus game will be considered in the following description), as follows:

$$ER\text{tot}=ER\text{base}+ER\text{bonus}$$

Where the house advantage "HA" is defined to be the following:

$$HA=1-ER\text{tot}$$

For a typical bonus game with frequency f, we may calculate ERbonus as:

$$ER\text{bonus}=\text{f}\times EV\text{bonus}$$

For example, consider a game with ERbase=0.6, f=0.005, and EVbonus=60, we find ERbonus=0.3 and ERtot=0.9. Thus, the house advantage is 10%. In the teachings of a multiple-path bonus herein, a bonus game is constructed with two possible paths each having EVbonus=60. In this way and as intended, the overall house advantage remains always 10% regardless of path chosen by the player in the bonus game.

However, for instance, one path may have an EV=60 while the other may have an EV=64. Then, ERbonus is bounded by the limits 0.3 (=0.005×60) and 0.32 (=0.005×64). Hence, ERtot is bounded by the limits 0.9 and 0.92, depending on the path selected by the player. The house advantage, though not constant, is thereby assured to be in the range of 8% to 10% and remains in a controlled fashion. Alternatively, one path may have an EV=30 and another EV=70, creating a house advantage assured to be in the range 5% to 25%. The total range is therefore 25%−5%=20%. If a player chooses randomly, the resultant house advantage will be the mean of the paths, in this case 15%. The difference between the player selected "best" path and the mean path in this example is therefore 15%−5%=10%.

While the foregoing has been described in terms of two paths, the number of paths, their associated EVbonus, the frequency of the bonus (and other bonuses), the relative contributions of ERbase and ERbonus, and so forth, are all design choices. Hence, the foregoing is meant to be illustrative and not limiting in nature. What is taught is the use of an overall game comprised of a base game and one or more bonus games. The bonus game has multiple paths, each path offering a potentially different expected value, but which nevertheless combined with the relative frequency of a bonus game, provide for an expected return on the overall game within calculable and acceptable limits.

Also, while the foregoing has been presented in terms of a bonus game, we note that the teachings of this invention may likewise be used as a game of chance in and of themselves. In this case, utilizing the formalism described above, ERbase=0 and f=1. Hence, ERtot=ERbonus=EVbonus. To assure a house advantage, clearly ERtot must be less than 1. Hence, EVbonus (the expected value of the bonus game per unit wager) must likewise be less than one.

Hence, in the example given earlier in which the EV of the game is 62.5, a possible method of implementing as a standalone game of chance is to require the player to wager, say 75 units to play the game. Then the normalized EVbonus, per unit wager, is 62.5/75=0.8333. The resulting house advantage is 16.67%.

We have shown therefore, that the method herein applies not only to bonus games but to games of chance in general. In particular, the same set of paths may be used as either a bonus game or a standalone game of chance. While the foregoing has described one method of utilizing the teachings herein in the form of a standalone game of chance, other design choices will be appreciated by those skilled in the art. Therefore, the preceding example should be considered an illustration only, and not meant to limit the teachings herein.

The teachings herein allow for considerable flexibility in designing pathways. As described, this includes the number of paths between the start and end, and their topology. While the above examples have the Start square as a node (with a choice), the Start square could also have no choice, leaving until later the opportunity for the player to make a decision.

The random means of traversing each path, is alos a design choice. Examples can include the spin of a wheel or arrow, the use of a wheel, the roll of dice, the flipping of a coin, random number generators, etc. Chance as used herein includes the mentioned random means, and any form of random selection whether specifically mentioned or otherwise so long as the result is arbitrary.

Figure 8:
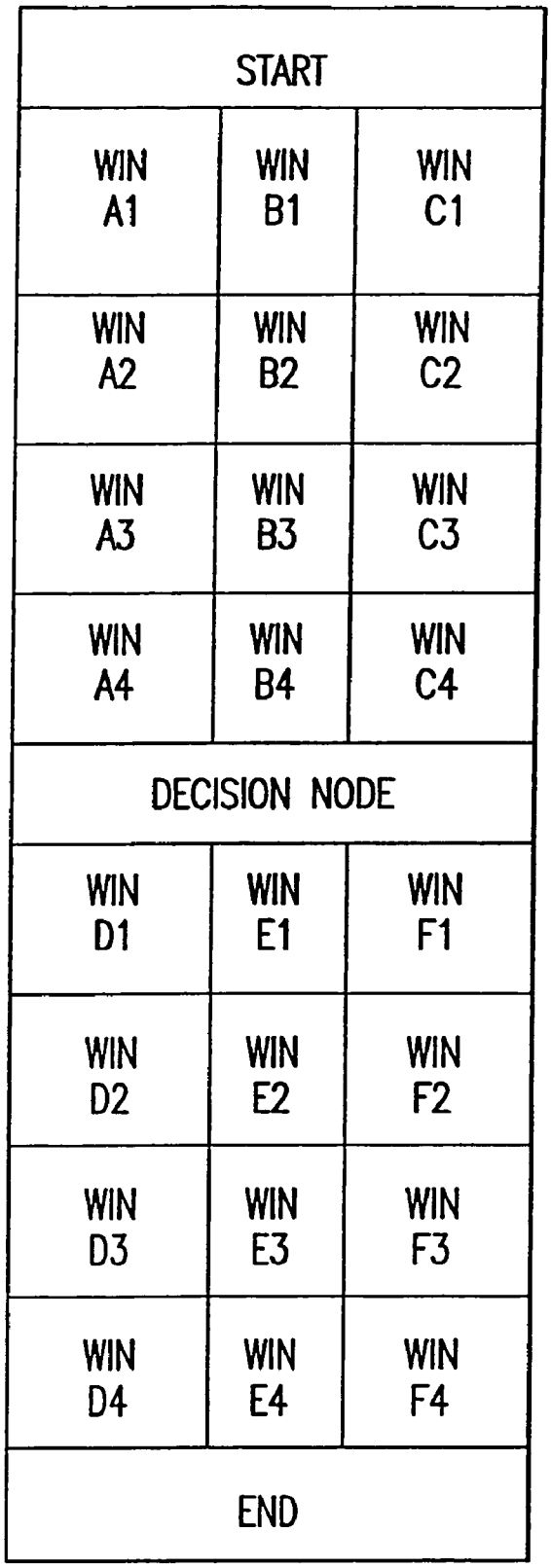
FIG. 8 is a further example showing an alternate form of game play.

In a preferred embodiment, the paths may have decision nodes, which allow for additional decisions to be made. For example, consider the following schematic path structure (in this example, wherein the values A1, A2, . . . , F3, F4) are not specifically portrayed, see for example FIG. 8.

Here, the player begins at the Start node and chooses one of three paths (A, B, or C) to traverse. Upon reaching the Decision node, the player must again choose one of three paths (D, E, or F) to follow. It should be appreciated that whether the player is stopped at the Decision position, or allowed to continue moving through this zone uninterrupted (while selecting the next path of D, E, or F) is a design choice. Furthermore, it may be desirable (when used as a bonus) to have the player complete the first section of the bonus (to the Decision node) upon first visiting a bonus game, only to return to play of the base game. Upon further qualification for a bonus, the player resumes the journey through the Decision node and selects the next path to take.

Other variations upon this general approach are also possible, including the use of multiple intermediate positions.

Lastly, we note that while we have presented each of the squares in a "winning" capacity (i.e., can't lose), it is also possible to have some squares as net losers (i.e., a negative amount is "won"). For example, consider the following two-path game in which a single coin is flipped for random movement, with heads moving forward one square and tails moving forward two squares, see for example FIG. 9.

As before, we find the following probabilities of landing on individual squares:

$P(1)=16/32$ $P(2)=24/32$ $P(3)=20/32$ $P(4)=22/32$ $P(5)=21/32$

The expected value, regardless of path chosen, is equal to 95.5625. Showing a method whereby the player may choose a path that has possible "losing" elements in addition to "winning" elements. Thus, what is shown is a method whereby non-risk-averse players wishing to gamble with a volatile path (and possibly losing) are also rewarded handsomely with increased awards on the potential winning squares.

Figure 10:
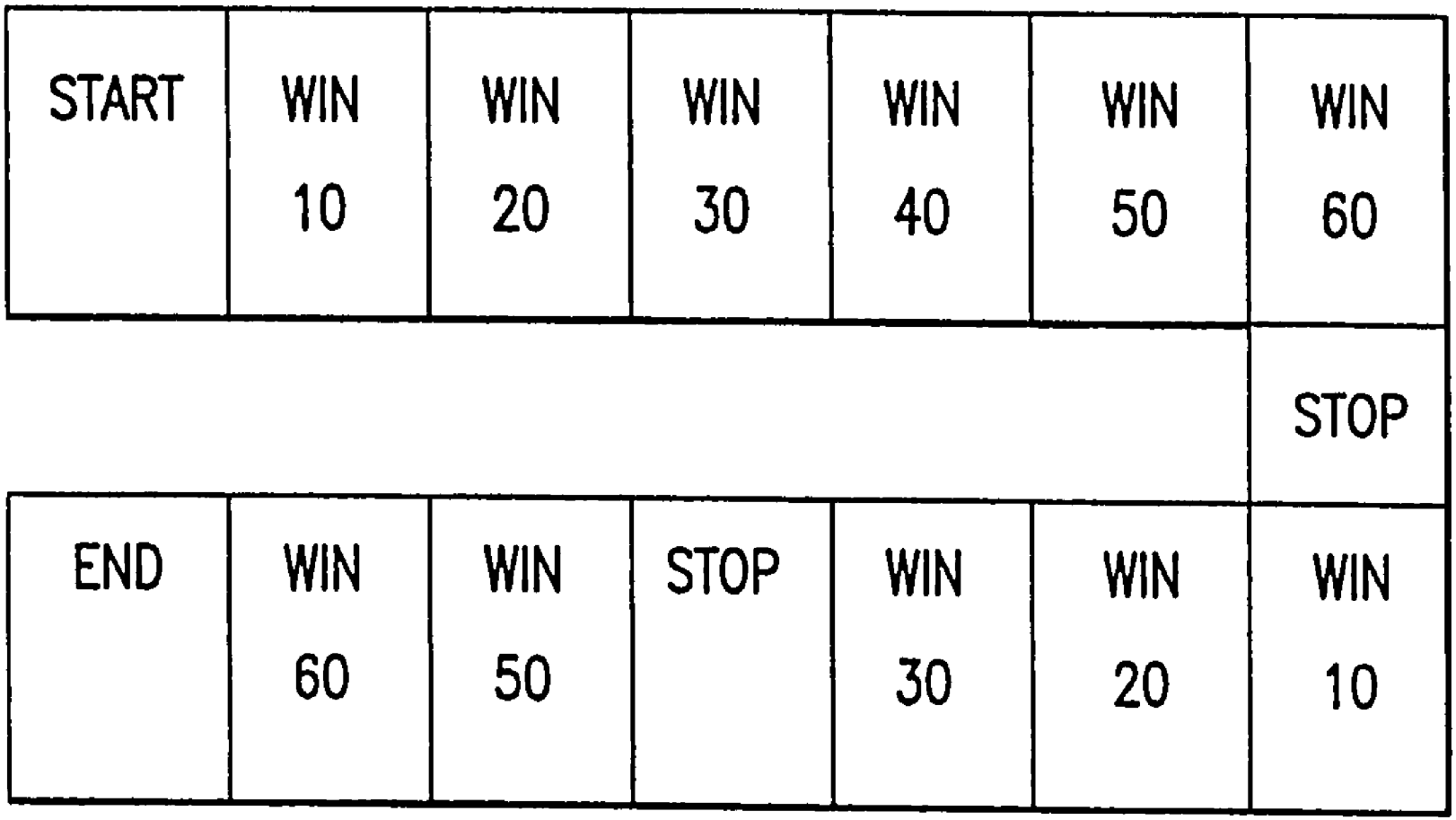
FIG. 10 is a still further example showing yet another form of game play.

In another preferred embodiment, certain squares are designated "stop" squares. These are squares in which the player pauses upon landing on the square. As such, the player stops on the square instead of traversing it in the normal fashion. The next move continues with the player initiating movement from the "stop" square. For example, consider FIG. 10 as a sample path.

If a single die is used to define moves around the path, then the following illustrative example demonstrates how the "Stop" square functions. The player begins at Start. If the first die roll is a 3, the player moves to the "Win 30" square. If the next die roll is a 2, the player moves to the "Win 50" square. If the next die roll is a 4, the player moves to the "Stop" square and stops there. If the next die roll is a 1, the player moves from "Stop" to the "Win 10" square. With a next die roll of 6, the player moves to the second "Stop" square. A final die roll of 4 ends the game.

Several paths of this type may be chosen among. The number and location of the Stop squares is a design choice. Too, the Stop squares, much like the Start, End, and Decision Node squares may also have a value, or other events, associated with them.

It is also within the scope of this invention to have designated squares act to move the player to other squares. This may be accomplished, e.g., via "Move ahead 3 squares" or "Go back 1 square" types of instructions. Alternatively, a square on path A may direct the player to move to a square on an alternate path (say B), thus further adding an element of surprise and suspense.

Lastly, while the examples above suggest monetary, or credit, wins/losses associated with each square, the extension to other items is also made. For example, certain squares may prescribe the play of an additional game. Provided the associated EV of such a game can be calculated, landing on the square and awarding the result of the game is mathematically equivalent to simply awarding the associated expected EV for the game. That is to say, the play of an additional game may be used to deliver a desired EV, rather than simply awarding the player a fixed amount. Note that the game may award a range of values and/or may involve strategy.

As another example, certain squares may allow players to acquire items that may later be exchanged for value. For example, consider a dessert-themed game in which predetermined squares allow the player to accumulate scoops of ice cream. Upon completion of the path, the player may receive an additional award based upon the number of scoops of ice cream collected. Again, the expected value of the path may be calculated traditionally, and includes as part of the calculation a determination of the value of the collected items.

Alternatively, the player may acquire items by several other means. These include random "gifts" as well as purchase via an additional wager. For example, after each movement, the player may have a 10% chance of being offered the sale of "fine art" to later be sold at auction (i.e., exchanged for value) upon completion of the game.

Also, the player may acquire privileges. For example, upon a certain chance outcome (e.g., a roll of 6 on a single die), the player may buy the privilege of choosing the next square landed upon. As another example, consider the case in which a player landing on a prescribed square may buy the opportunity to double all remaining square values. The means of acquiring items or privileges, whether randomly, by squares landed upon, by purchase, and so forth, is a design choice, and the foregoing is not meant to be limiting.

While the examples illustrating the play and different options for the casino games are explained throughout the preceding disclosure, skilled artisans will appreciate that many variations of the execution will be possible. The specific examples should not be considered limiting and the particular casino game equipment shown in FIG. 1 is merely for depiction of but one example of form. In that regard, there is shown a casino game of chance 10 for at least one player. The casino game of chance 10 has a game surface 11 accessible and visible to the player to play the casino game of chance 10. A plurality of paths 12 on the game surface are arranged for the player, currently shown on selected path 13. A plurality of nodes 14 represent points at which the player must choose which subsequent path to traverse. The plurality of paths 12 and nodes 14 can be in the form of a lighted display or video screen as shown for example in FIG. 1. In a well known manner in gaming the game surface 11 may be an interactive structure such as a touch screen, if a video, for the purpose of path selection. As disclosed throughout the preceding detailed description there may be value positions, intersections, and other positions along the paths 12 as part of a particular game.

During play there is a need to show the position on the path 13. In the preferred embodiment, movable indicia 16 on the game surface 11 show the position on the player selected path 13. In the physical embodiments of the casino game of chance 10, the movable indicia 16 can include tokens, graphic representation, icons and video depictions depending on the chosen interactive structure for the casino game of chance 10.

A mechanism of chance 17 carried on the game surface 11 is available to the player. The mechanism of chance 17 is for determining the random movement of the indicia 16 along the player selected path 13 and for awarding the player any values associated with positions along the selected path 13. As set forth herein before the mechanism of chance 17 can include, spinners, FIG. 2 dice, FIG. 3 wheels, FIG. 4 for random number generations or a coin for flipping, FIG. 5 etc. The expected value for each possible player choice of paths is designed to preserve the house advantage and make the casino game of chance 10 commercially viable.

Figure 2:
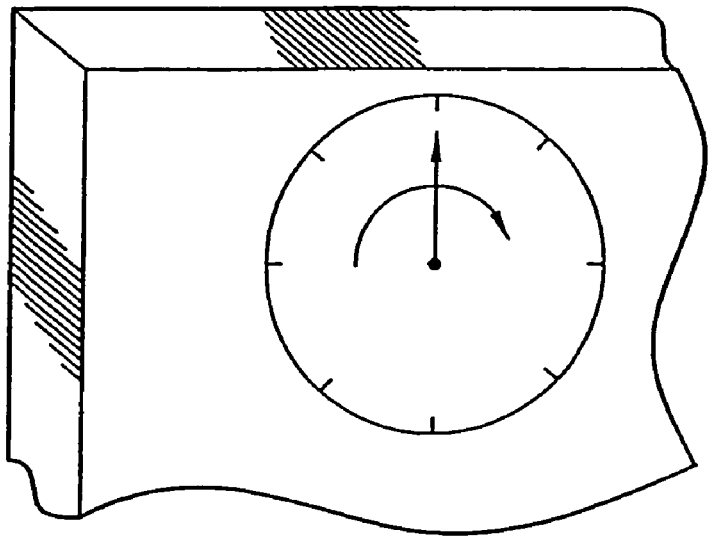
FIG. 2 is a partial view of a casino game spinner used for random selection.
Figure 3:
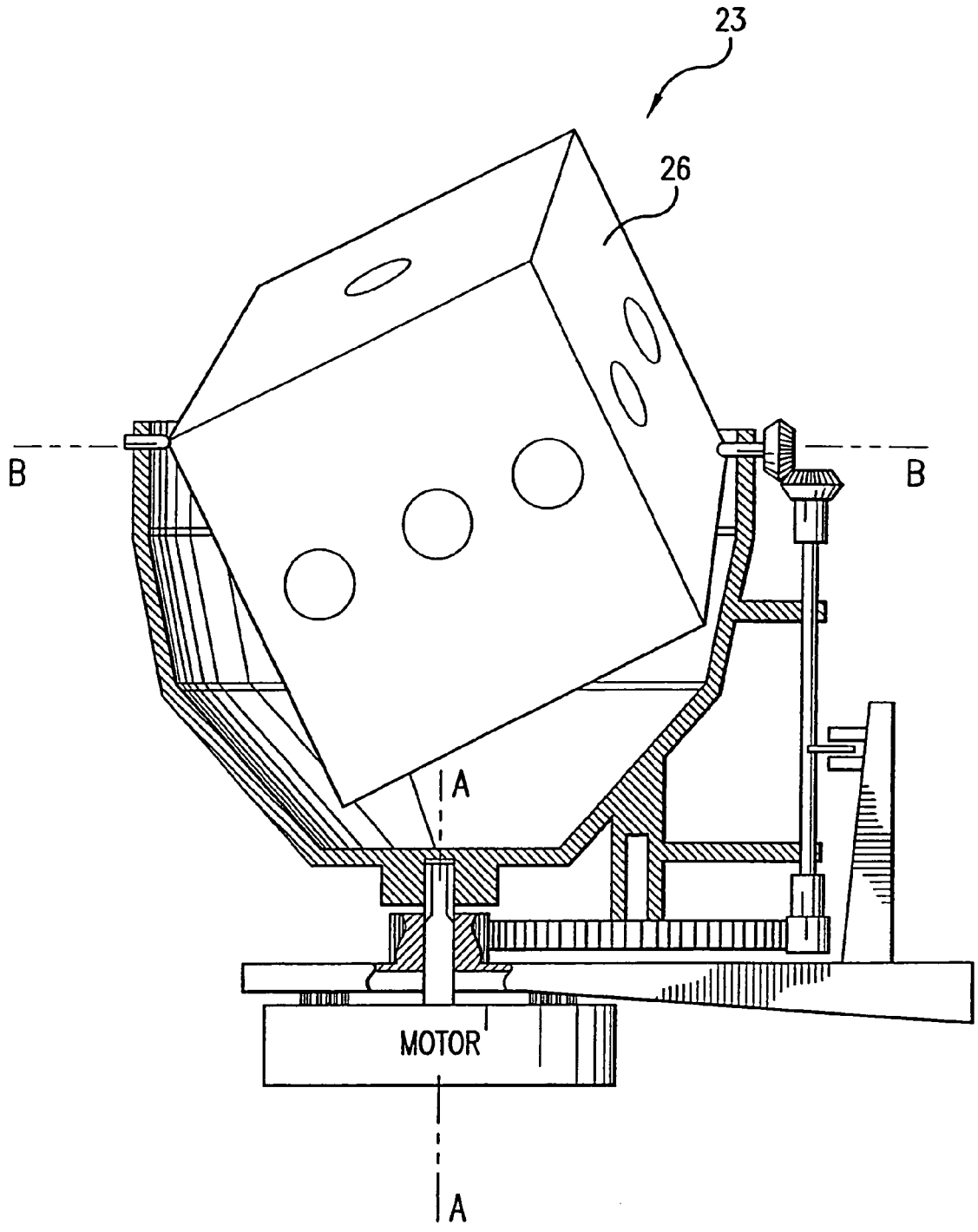
FIG. 3 is a partial view of a casino game die used for random selection.

FIG. 1 shows the bonus game atop a slot machine in a conventional manner according to the way in which bonus games are provided in the casino games discussed in the background of this disclosure. FIG. 2 is a view of a spinner used as a random selection means with the present bonus game the spinner would be rotated during game play by a motor or virtually on a video by control of the random number generator in the casino game. Similarly, FIG. 3 is a view of a die used for random selection. Motorized die 26 or virtual die on a video screen for random number selection are well known in casino equipment. U.S. Pat. No. 5,803,451 has the Starpoint IDU Modular Dice Mechanism of FIG. 3 and the description therein is incorporated herein by reference and made a part hereof. The preferred automatic mechanism for each spinning die 26 is commercially available from Starpoint Electrics Limited of Morden, Surry in the United Kingdom.

Figure 5:
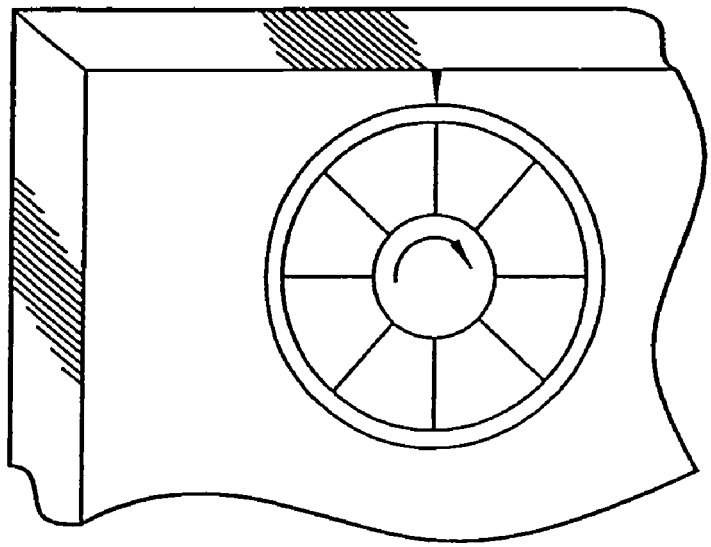
FIG. 5 is a partial view of a casino game wheel used for random selection.
Figure 4:
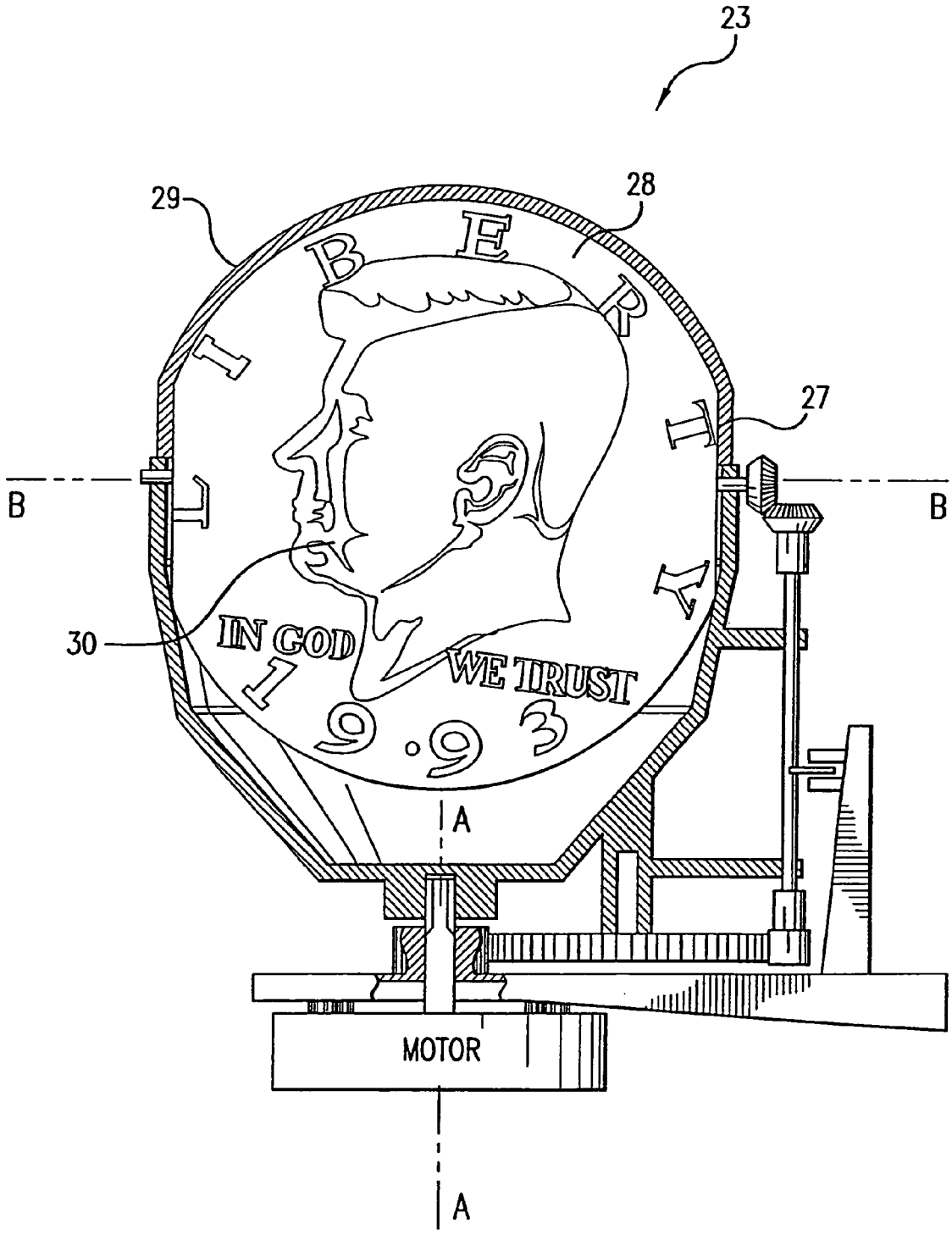
FIG. 4 is a partial view of a casino game coin used for random selection.

The die 26 can easily be replaced by a coin 27 as in FIG. 4 used for random selection. In particular, instead of the die 26 a two-sided coin 27 can be mounted to spin about its A—A or B—B diameter. The die 26 or coin 27 would be spun by output of the random generator. The coin 27 has opposed sides with a head or tail. FIG. 5 is partial view of a game having a wheel used for random selection. Wheels may been spun by the dealer, a motor or as a virtual video wheel; the latter two wheels are typically controlled by a random number generator in many types of casino equipment. U.S. Pat. No. 5,823,874 has a bonus indicator is in the form of a rotating bonus wheel that can be caused to spin automatically or in response to some action by a player, e.g., pushing a button so the primary reels indicate one of a predetermined plurality of indicia. When the wheel stops, a pointer indicates the bonus payout to be awarded to the player. Be it a wheel FIG. 5 or a spinner FIG. 2 the idea of a random selection is common in this field.

Those skilled in the art will appreciate the plethora of possibilities associated with accumulating items and/or privileges that may increase in value, lose value, or otherwise play a part in the expected value for the bonus sequence. What is material is the use of acquisition by the player of certain items and privileges, each of which affects the potential outcome of game, but which nevertheless allows for the calculation of a controlled and limited range of expected values for the game.

What is claimed:

1. A method for operating a casino game of chance in response to a wager against a house, the casino game of chance having random entry from a base game to a bonus game, the method for playing the casino game of chance comprising:

providing in a display a plurality of paths for play of the bonus game upon random entry from the base game, each of the plurality of paths having a plurality of positions, at least one of the plurality of positions having an associated value;

displaying a random number of moves in the bonus game under control of the casino game of chance;

moving an indicia, in response to the provided random number of moves, along one path of said plurality of paths a corresponding number of positions corresponding to the displayed random number of moves to land on a position in the display;

repeating the aforesaid steps of displaying and moving in response to landing on the position until the bonus game ends;

awarding, in the bonus game, based upon any value associated with each position landed on;

providing a fixed player expected value yielding an overall house advantage for all play of the casino game of chance, in the bonus game for each of the plurality of paths.

2. The method of claim 1 wherein each of the plurality of paths has the same number of positions.

3. The method of claim 1 wherein each of the plurality of paths has a different number of positions.

4. The method of claim 1 wherein at least one of the plurality of paths has a different number of positions from the remaining plurality of paths.

5. The method of claim 1 wherein at least one of the plurality of positions for at least one of the plurality of paths is a stop position and wherein moving along the one path further comprises:

always stopping at a stop position on the one path during moving the indicia so as to stop moving along the one path.

6. The method of claim 1 wherein at least one of the plurality of positions for at least one of the plurality of paths is a move position.

7. The method of claim 6 wherein the move position when landed on by the indicia further causes the indicia to move a given number of positions back along the one path under control of the casino game of chance.

8. The method of claim 6 wherein the move position when landed on by the indicia further causes the indicia to move a given number of positions forward along the one path under control of the casino game of chance.

9. The method of claim 6 wherein the move position when landed on by the indicia causes the indicia to move to a given position on another path in the plurality of paths thereby continuing play of the bonus game, under control of the casino game of chance, on the aforesaid another path.

10. The method of claim 1 wherein the associated value is an award.

11. The method of claim 1 wherein the step of displaying occurs from any one of the following:

spinning a mechanical spinner, rotating a mechanical wheel, rolling at least one mechanical die, or flipping a mechanical coin.

12. The method of claim 1 wherein the step of displaying randomly provides a number equal to zero so as not to move the indicia along the one path.

13. The method of claim 1 wherein at least one of the plurality of positions for at least one of the plurality of paths is a game play position, so that when the game play position is landed by the indicia , a game is played under control of the casino game of chance.

14. The method of claim 1 further comprising:

providing a node at a plurality of intersecting paths in the plurality of paths in the play of the bonus game of the casino game of chance;

the play of the bonus game continuing on one of the plurality of intersecting paths when the node is encountered in response to moving the indicia a corresponding number of positions.

15. The method of claim 1 wherein awarding further comprises:

providing, under control of the casino game of chance, one of the following values: money, credits, privileges, items, gifts or another game.

16. The method of claim 1 wherein the fixed player expected value is the same for each of the plurality of paths.

17. The method of claim 1 wherein the fixed player expected value for each of the plurality of paths falls within a predetermined percentage.

18. The method of claim 1 wherein a house advantage for the casino game of chance is within a predetermined range, the predetermined range at least determined by the fixed player expected value of each of the plurality of paths, and the random entry to the bonus game from the base game.

19. The method of claim 1 wherein the bonus game ends when the moving the indicia encounters an end position on the one path.

20. The method of claim 1 wherein the associated value includes an award that is a negative amount so as to represent a loss.

21. The method of claim 1 wherein the fixed player expected value for at least one of the plurality of player paths is different from the remaining paths.

22. The method of claim 1 wherein the fixed player expected value for each of the plurality of player paths is different from the remaining paths.

23. The method of claim 1 wherein the fixed player expected values for each of the plurality of paths varies from bonus game play to bonus game play under control of the casino game of chance.

24. A method for operating a casino game of chance in response to receiving a wager against a house, the method for playing the casino game of chance comprising:

providing in a display of the casino game of chance a plurality of paths for play of the casino game of chance, each of the plurality of paths having a plurality of positions, at least one of the plurality of positions having an associated value;

displaying on the display a random number of moves under control of the casino game of chance;

moving an indicia, in response to the displayed random number, along one path of said plurality of paths a corresponding number of positions to land on a position in the display;

repeating the aforesaid steps of displaying and moving until the casino game of chance ends;

awarding an award in the casino game of chance based upon any value associated with each position landed;

providing player expected values for the plurality of continuing paths; the provided player expected values yielding an overall house advantage for all play of the casino game of chance within a range having calculable limits.

25. A method for operating a casino game of chance based on a wager against a house, the casino game of chance having random entry from a base game to a bonus game, the base game having a player expected return, the method for playing the casino game of chance comprising:

providing in a display at least one path for play of the bonus game upon random entry from the base game at a relative frequency, the at least one path having a plurality of positions;

providing a node in the at least one path;

providing in the display a plurality of continuing paths from the node, each of the plurality of continuing paths having a plurality of continuing positions;

displaying, under control of the casino game of chance, a random number of moves in the bonus game for the at least one path;

moving, in response to the displayed random number, along the at least one path to said node and then along one of the plurality of continuing paths a corresponding number of positions to land on a continuing position in the one continuing path;

providing player expected values for the at least one path with each of the plurality of continuing paths;

when the provided player expected values are combined with the relative frequency of the bonus game and the player expected return of the base game, an overall house advantage for all play of the casino game of chance is obtained within a range having calculable limits.

26. A method for operating a casino game of chance in response to a wager against a house, the casino game of chance having random entry from a base game to a bonus game, the method for playing the casino game of chance comprising:

playing the base game in response to the wager, the base game having a player expected return;

providing in a display at least one path for play of the bonus game upon random entry from the base game at a relative frequency, the at least one path having a plurality of positions;

providing a node in the at least one path;

providing in the display a plurality of continuing paths from the node, each of the plurality of continuing paths having a plurality of continuing positions;

displaying, under control of the casino game of chance, a random number of moves in the bonus game for the at least one path;

moving an indicia, in response to the displayed random number, along the at least one path a corresponding number of positions to the random number;

when said node is landed on by the indicia during moving, then ending bonus play with the indicia at the node;

resuming play of the bonus game by the player upon random re-entry from continued play of the base game and continuing play of the bonus game by providing a new random number and by moving the indicia along one of the plurality of continuing paths a corresponding number of continuing positions to the new random number;

providing player expected values for the at least one path with each of the plurality of continuing paths;

when the provided player expected values are combined with the relative frequency of the bonus game and the player expected return of the base game, an overall house advantage for all play of the casino game of chance is obtained within a range having calculable limits.

* * * * *